US007516795B2

(12) United States Patent
Lopes Euphemio et al.

(10) Patent No.: US 7,516,795 B2
(45) Date of Patent: Apr. 14, 2009

(54) SUBSEA PETROLEUM PRODUCTION SYSTEM METHOD OF INSTALLATION AND USE OF THE SAME

(75) Inventors: Mauro Luiz Lopes Euphemio, Rio de Janeiro (BR); João Siqueira de Matos, Rio de Janeiro (BR); Roberto Rodrigues, Rio de Janeiro (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 510 days.

(21) Appl. No.: 11/205,872

(22) Filed: Aug. 17, 2005

(65) Prior Publication Data

US 2006/0118310 A1 Jun. 8, 2006

(30) Foreign Application Priority Data

Aug. 17, 2004 (BR) ..... 0403295

(51) Int. Cl.
*E21B 29/12* (2006.01)

(52) U.S. Cl. ..... 166/357; 166/368; 166/268

(58) Field of Classification Search ..... 166/357, 166/368, 366, 367, 266, 268, 275
See application file for complete search history.

(56) References Cited

U.S. PATENT DOCUMENTS 4,194,857 A * 3/1980 Chateau et al. ..... 405/203
4,813,495 A * 3/1989 Leach ..... 175/6
5,154,741 A * 10/1992 da Costa Filho ..... 96/157
6,068,053 A * 5/2000 Shaw ..... 166/267
6,102,673 A * 8/2000 Mott et al. ..... 417/392
6,230,810 B1 * 5/2001 Rivas ..... 166/357
6,230,824 B1 * 5/2001 Peterman et al. ..... 175/214
6,394,195 B1 * 5/2002 Schubert et al. ..... 175/69
6,457,529 B2 * 10/2002 Calder et al. ..... 166/368
6,474,422 B2 * 11/2002 Schubert et al. ..... 175/69
6,508,308 B1 1/2003 Shaw
6,651,745 B1 * 11/2003 Lush et al. ..... 166/357
7,150,325 B2 * 12/2006 Ireland et al. ..... 166/366
7,249,634 B2 * 7/2007 de Albuquerque Lima Goncalves et al. ..... 166/335
7,314,084 B2 * 1/2008 Rodrigues et al. ..... 166/344

OTHER PUBLICATIONS

English Translation of Brazilian Application PI 400926-6.

* cited by examiner

*Primary Examiner*—Thomas A Beach
(74) *Attorney, Agent, or Firm*—Sughrue Mion, PLLC

(57) ABSTRACT

A subsea petroleum production system for artificial lift, including a pumping module coupled to a flow base, the system being installed downstream of a Wet Christmas Tree (WCT) on the seabed. The pumping module includes at least one submersible centrifugal pump (SCP) inclined with respect to the vertical direction at an inclination of up to 85 degrees from the vertical direction, wherein a flow in said at least one pump is ascending.

9 Claims, 7 Drawing Sheets

SUBSEA PETROLEUM PRODUCTION SYSTEM METHOD OF INSTALLATION AND USE OF THE SAME

The present invention relates to the field of subsea systems with artificial lift for petroleum production.

BACKGROUND OF THE INVENTION

The use of centrifugal pumps in petroleum wells increases the production flow. However, when centrifugal pumps are utilized in wet completion well installations, the cost of intervention for maintenance is high. Specifically, maintenance of the centrifugal pump requires: i) interruption of production of the well, ii) retrieval of the production column, pump and accessories of the well, and iii) the use of a probe for maintenance of the pump. In many cases these items represent an obstacle, not only with regard to production profits, but also with respect to the production process.

Brazilian Application No. PI 0400926-6 entitled "Subsea Pumping Module System and Installation Method of the Same" describes an alternative configuration in which a pumping unit is installed in an auxiliary or dummy well, where it is easier to retrieve the pumping unit for maintenance. However, because it is necessary to construct this auxiliary or dummy well, the cost of production is higher. Even construction of a hollow pile may represent an increase in costs.

U.S. Pat. No. 6,508,308 (hereinafter U.S. '308) describes multi-stage methods for production in a wellhead, which includes fluid pumps operated sequentially during the life of the well. In the embodiments described in U.S. '308, the production column is bifurcated into a pair of legs. One of the legs includes a first fluid pump which may be actuated in a selective manner to facilitate fluid flow through that leg. A sliding glove and a flapper valve diverter are also provided to block production flow through that leg or the other leg to permit the selective use of the first fluid pump.

Thus, U.S. '308 discloses production systems that can produce oil without removing the production column from the well. The described systems include a "Y"-shaped block assembly with two legs. The "Y"-shaped block is suspended at the lower end of a production column. One of the legs supports a first fluid pump.

The first fluid pump, which is positioned within the production column, is used until it ceases operation. Then, the second fluid pump is introduced into the production column with the assistance of coiled tubing. The fluid is thereafter lifted to the surface using the second fluid pump. This eliminates the need to remove the production column from the well to replace the first fluid pump. When the second fluid pump ceases to operate, it may be easily removed from the well and replaced without the time and costs associated with removing the production column from the well.

Despite the technological advances in the art, there continues to be a need for a subsea petroleum production system that may be installed and recovered by cable. Such a production system is described and claimed in this application.

SUMMARY OF THE INVENTION

In a broad sense, the present invention relates to a subsea petroleum production system which includes a subsea pumping module provided downstream of a Wet Christmas Tree (WCT) on the seabed. The subsea pumping module comprises at least one submersible centrifugal pump (SCP) and is coupled with a flow base, which permits a petroleum production bypass. The hereinafter SCP pumping module and the flow base may be installed and recovered by a cable.

The invention provides a subsea petroleum production system which can be installed by an anchoring vessel or a cable installation vessel, having low daily costs.

The invention provides a subsea production system which integrates dedicated technology such as electric centrifugal pumps operating in the inclined position, underwater engineering and installation technology.

The invention also provides a subsea petroleum production system which can be quickly tested and replaced, with the provision of an associated backup being sufficient.

The invention provides a subsea petroleum production system which permits functional tests of the integration of pump/motor/electrical systems on land prior to installation and offshore placement on the seabed.

The invention also provides a subsea petroleum production system which enables the reuse of cables, electrical connectors, flying leads, etc., should a pump be replaced.

The invention also provides a subsea petroleum production system which simultaneously reduces production shutdown time (time spent awaiting a rig plus actual work time), and reduces costs.

The invention also provides a subsea petroleum production system which operates on the seabed and is subjected to temperature changes, including extreme low temperatures.

The invention provides a subsea petroleum production system which enables the launch of the structure with a production line.

The invention provides a subsea petroleum production system in which the flow base and the pumping module can be relocated.

The invention equally provides a subsea petroleum production system which boosts multiphase flow.

The invention also provides a subsea petroleum production system which enables the injection of water in an injection well to keep pressure in the petroleum reservoir while the production well produces the desired petroleum.

The invention provides a subsea petroleum production system which permits the transfer of petroleum between points of collection, for example, between two production platforms or between a platform and a vessel.

The invention provides a subsea petroleum production system to be utilized in series, thus enabling long distance transport of multiphase fluid.

The invention also provides a method of installing the subsea petroleum production system.

BRIEF DESCRIPTION OF THE DRAWINGS

The above and/or other aspects of the present invention will become apparent and more readily appreciated from the following description of the exemplary embodiment, taken in conjunction with the accompanying drawings, in which:

FIG. 3A depicts two centrifugal pumps arranged in an "X" (i.e., in series).

FIG. 3B shows two centrifugal pumps arranged in parallel. FIG. 3C illustrates two pairs of two centrifugal pumps in an X (series).

FIGS. 4A through 4E show the steps of the method.

FIGS. 5A through 5D show the steps of the installation method.

DETAILED DESCRIPTION OF THE EXEMPLARY EMBODIMENTS

Figure 1:
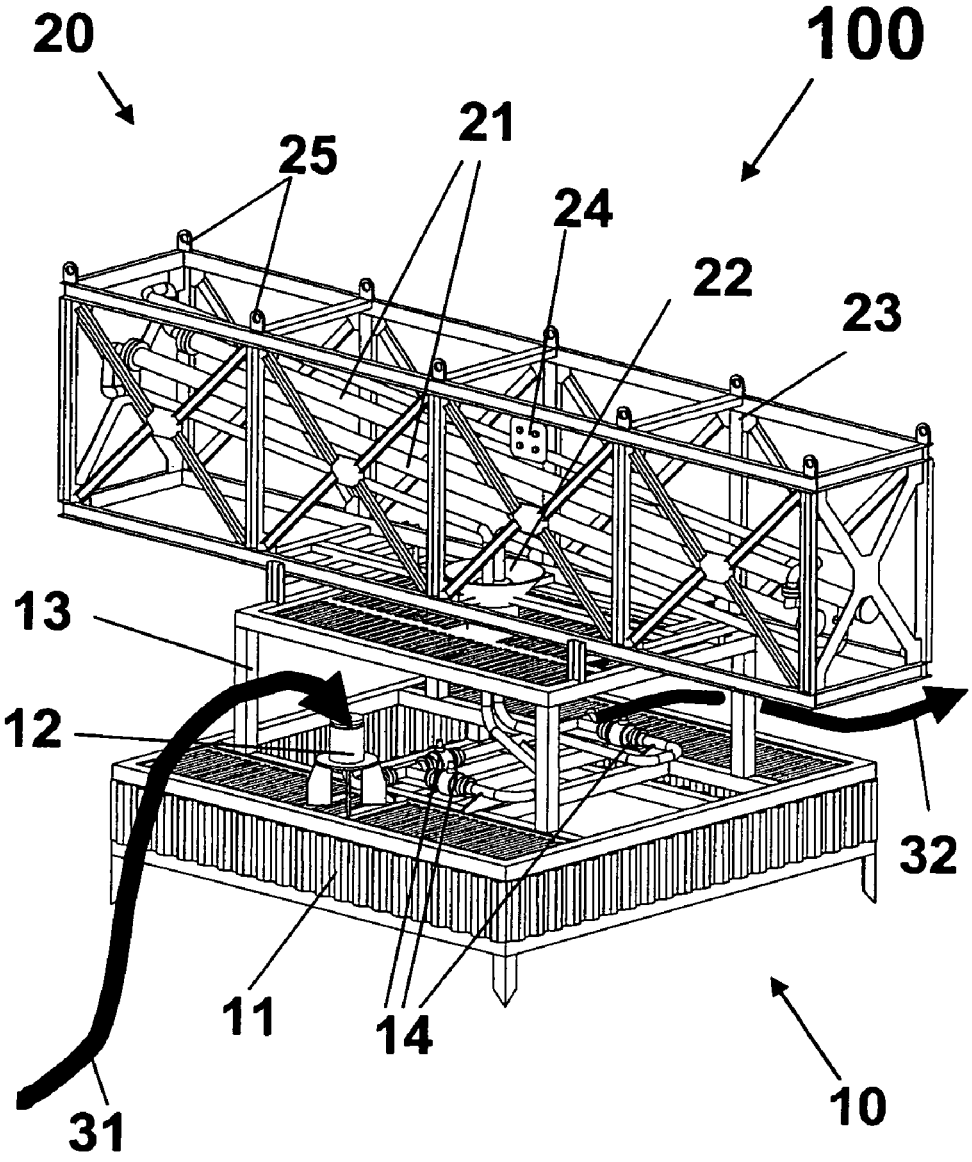
FIG. 1 is a schematic of a SCP module installed on the flow base in accordance with one exemplary embodiment of the invention.

Reference will now be made in detail to embodiments of the present invention, examples of which are illustrated in the accompanying drawings, wherein like reference numerals refer to like elements throughout. The exemplary embodiments are described below so as to explain the present invention by referring to the figures.

As is described herein and shown in FIG. 1, one exemplary embodiment of the present invention includes at least one submersible centrifugal pump—SCP (21), usually utilized inside petroleum wells on the seabed. In this configuration, at least one SCP (i.e., pump, motor and accessories), is mounted with an inclination of up to 85 degrees with respect to the vertical direction in a pumping module (20). The pumping module (20) is installable and recoverable by a cable. The pumping module (20) is coupled to a flow base (10). A pig (i.e., line-cleaning device) can be passed through the flow lines of the flow base (10). The flow base (10) has a ground stabilizing skirt (11), which is directly supported on the seabed and may be installed alone or together with a flow line (32).

In accordance with the architecture described above, in the case of the removal of the SCP pumping module (20), a bypass feature of the production flow lines enables production to continue through an alternative method, for example, a gas lift.

The present concept utilizes standard equipment/components from suppliers. Furthermore, the pump, motor and their accessories are also conventional, commercially available equipment.

Underwater mechanical and electrical connectors, as well as interfaces for a remote operated vehicle (ROV) and are also readily available.

One of the important aspects of the subsea production system is the installation and retrieval of the system by cable utilizing the method "buoy and chains," pioneered by PETROBRAS, which avoids the need for a rig for such procedures.

FIG. 1 illustrates a schematic view of the SCP pumping module (20) installed on a flow base (10) according to one exemplary embodiment of the invention.

Although FIG. 1 depicts an embodiment with two pumps, the concept of the invention also contemplates an embodiment having a single pump SCP (21). It is also evident that a pumping module with an odd number of pumps is also encompassed within the scope of the invention.

In FIG. 1 the subsea production system (100) of the invention includes a flow base (10) and a pumping module (20). The flow base (10) includes a main portion and a support structure (13) positioned between the main portion of the flow base (10) and the pumping module (20).

A flow base (10) is provided with an inlet connection (12) (e.g., hub or flange) for receiving a production flow line (31) upstream of the subsea production system (100) and an exit connection to a production flow line (32) downstream of the subsea production system (100). Control valves (14) permit the directing of inlet and outlet flows as it is deemed necessary. As mentioned above, the flow base (10) also has a ground stabilizing skirt (11), which is directly supported on the seabed.

A pumping module (20) includes at least one SCP (21) arranged in series or parallel with one or more submersible centrifugal pumps, and inclined up to 85 degrees with respect to the vertical direction. The pumping module (20) also includes a hydraulic connector (22) for coupling the pumping module (20) to the flow base (10). A base structure (23) protects the at least one SCP (21) from external forces. The base structure (23) is provided with devices (25), which are compatible with installation tools and a panel (24) that provides the requisite electrical connections.

Figure 2:
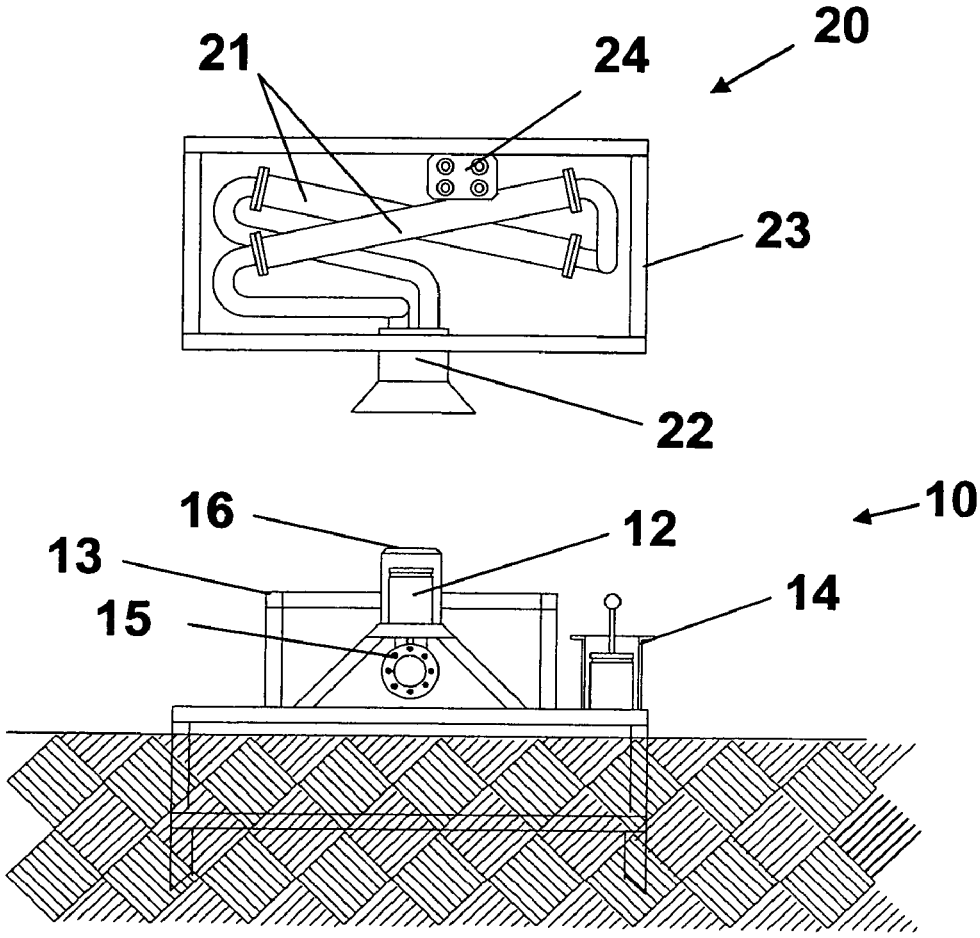
FIG. 2 shows the coupling of a flow base to centrifugal pumps.

FIG. 2 shows the coupling of a flow base (10) with two SCP (21). The flow base (10) includes the inlet connection (12) (e.g., hub or flange), an exit connection (15) (e.g., hub or flange), and a hub (16) for coupling a pumping module (20).

The hydraulic connector (22) connects an SCP (21) to a flow base (10) through a hub (16).

Figure 3A:
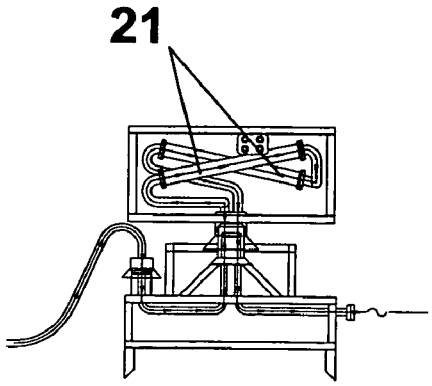
FIGS. 3A, 3B and 3C illustrate centrifugal pumps arranged in different configurations.

FIG. 3A shows a subsea production system with a typical centrifugal pump (21) in the form of an "X" configuration, designated "configuration X-SCPs." In this configuration the pumps are connected in series.

Figure 3B:
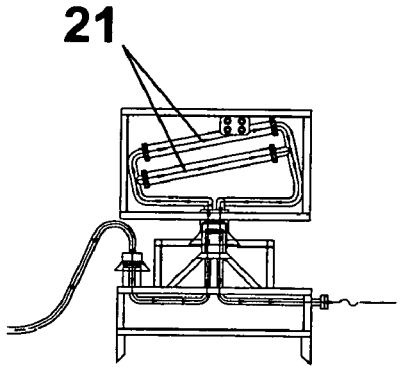
Figure 3C:
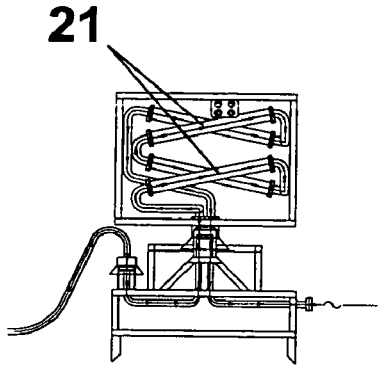

In FIGS. 3A, 3B and 3C, because two SCP (21) are inclined at an inclination of up to 85 degrees with respect to the vertical direction, the production flow through SCP (21) is always ascending. This avoids problems caused by the presence of gas in the system.

FIG. 3B depicts a configuration of two SCP arranged in parallel in which it is possible to obtain an increased production flow while $\Delta P$ is maintained constant.

FIG. 3C shows a configuration of a pumping module (21) with two pairs of SCP (21) in series in which it is possible to obtain an increase in $\Delta P$ while flow is maintained constant.

FIGS. 4A through 4E depict a method of installation of the subsea production system (100) of an exemplary embodiment of the invention in a new wellhead (50).

Figure 4A:
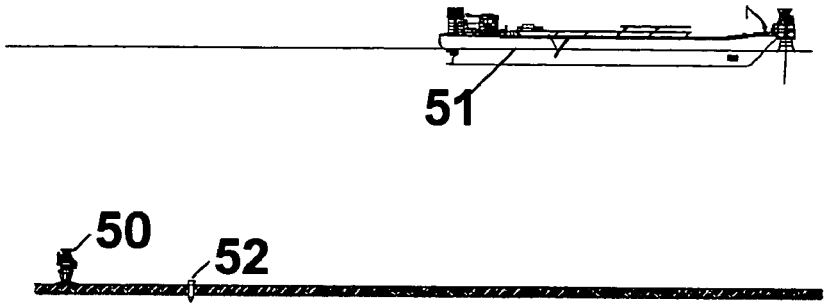
FIGS. 4A through 4E show a method of installation of an X-SCP system in a new wellhead installation.

FIG. 4A shows the installation of a new wellhead or WCT (50) with a production unit (51). The production unit (51) may also be a platform or any other type of production unit. A pile (52) is fixed in the seabed for positioning the flow base (10) and the subsea production system (100) itself. The use of a pile (52) is a conventional technique for positioning equipment on the seabed.

Figure 4B:
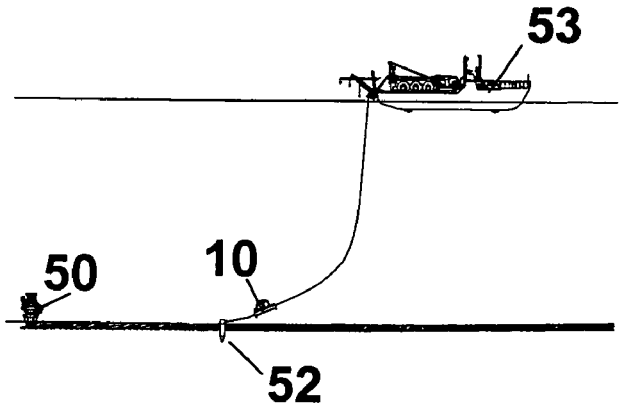

FIG. 4B illustrates the installation of a flow base (10) by a vessel (53) which may be either a cable installation vessel or an anchor vessel. The transportation of the flow base (10) may be accomplished by the vessel itself, by a raft or tug.

Figure 4C:
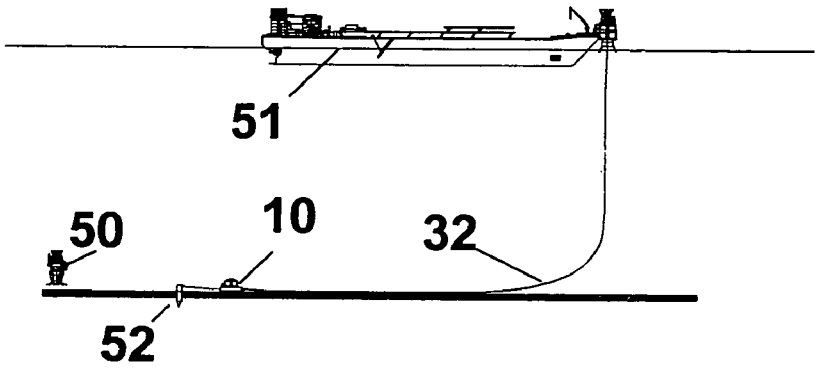

FIG. 4C shows the base (10) installed with a flow line (32) and "pull-in" accomplished by a production unit (51).

Figure 4D:
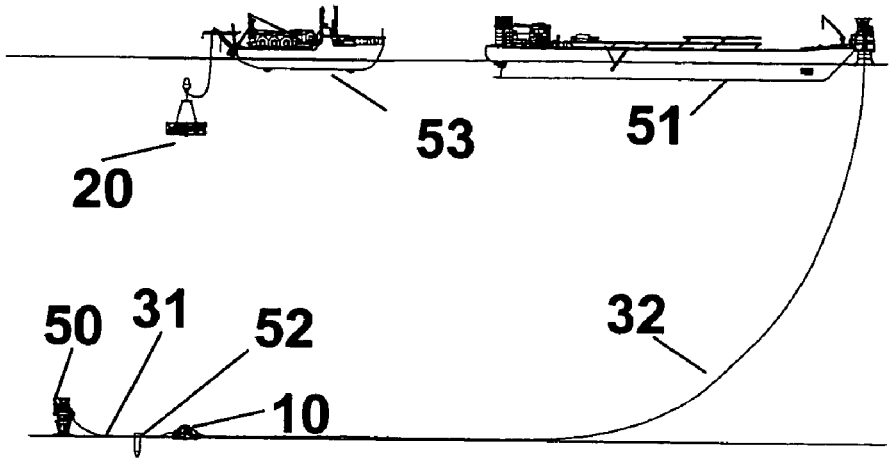

FIG. 4D shows the coupling of a SCP pumping module (20) to a flow base (10). An advantage of the herein described exemplary embodiment is that the flow base (10) may be installed along with the production flow line (32). Alternatively, the flow base (10) may be installed first, followed by the installation of the flow line (32). A production flow line (31) connects the flow base (10) to the wellhead (50).

Figure 4E:
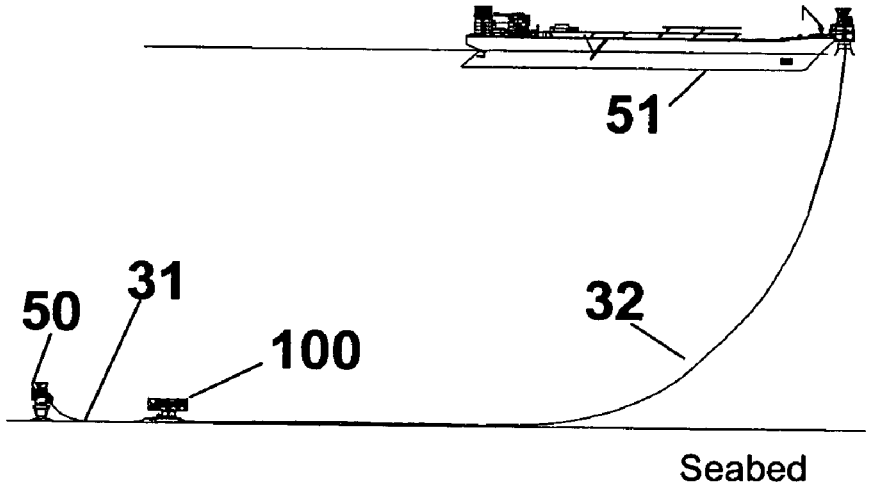

FIG. 4E depicts a subsea system (100) installed on the seabed.

FIGS. 5A through 5D illustrate the method for installing a system (100) in an existing wellhead (50).

Figure 5A:
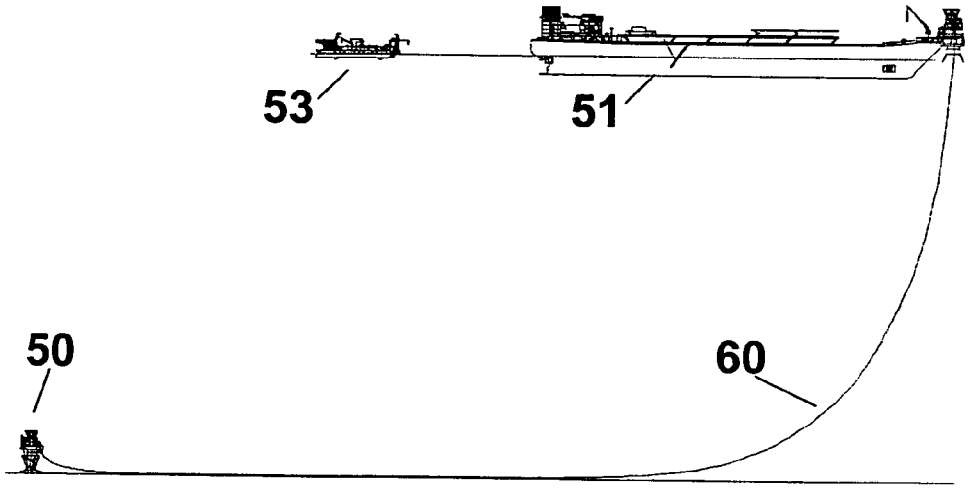
FIGS. 5A through 5D show another method of installation of an X-SCP system in an existing well with a bundle.

FIG. 5A depicts an existing wellhead (50) with a bundle (60) defined as a set of lines. The bundle (60) is composed of three lines, a production line (61), a service line (62) and a control line (63).

Figure 5B:
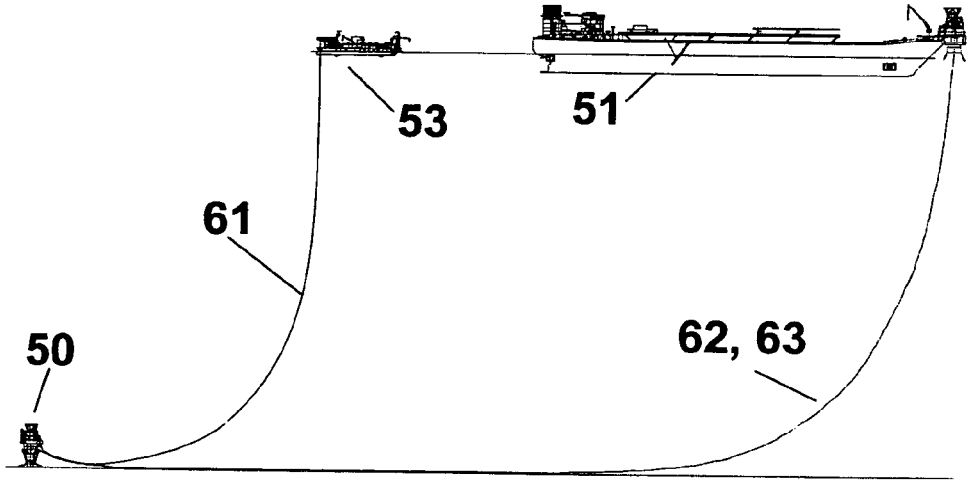

FIG. 5B illustrates a vessel (53) that retrieves a production line (61) while lines (62) and (63) remain connected to a production unit (51). The line (61) is carried by the vessel (53).

Figure 5C:
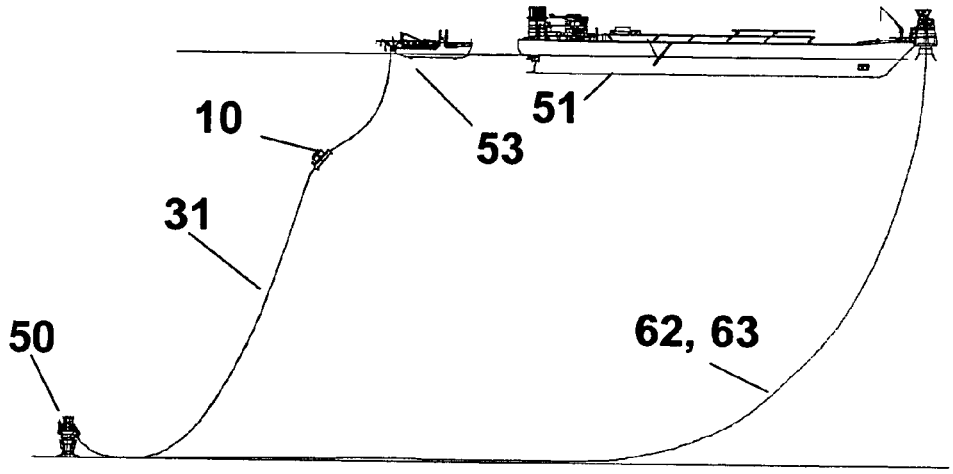

In the next stage of the installation method, the position of a production line (61) where the position of a flow base (10) is determined by calculation. Thereafter, as is shown in FIG. 5C, the procedure of lowering a flow base (10) to the seabed is initiated.

Figure 5D:
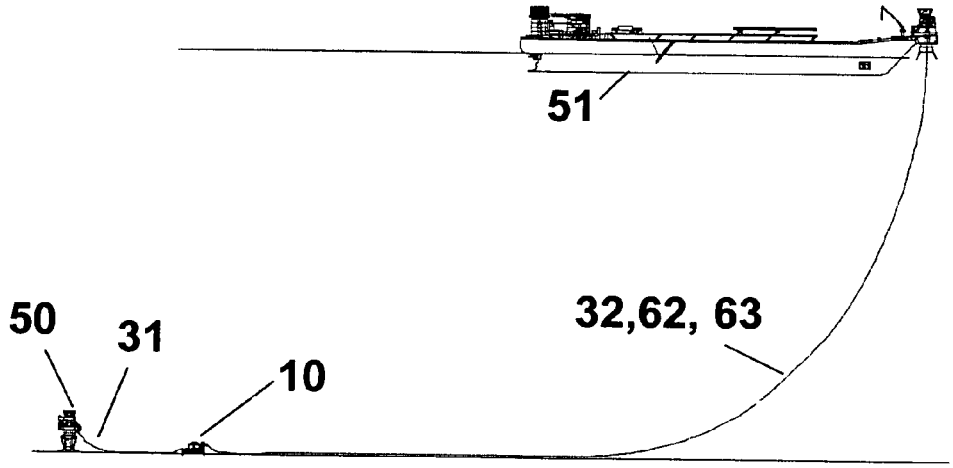

FIG. 5D shows the completion of a flow base (10) installation.

The installation of the pumping module (20) is accomplished according to the method shown in FIG. 4D.

In conclusion, it may be said that the exemplary embodiments of the invention represent an alternative, among others, with regard to the employment of multiphase pumps up to the approximate limit of 60% of gas fraction present in the multiphase flow.

It is important to appreciate that the description of the methods of installation of a subsea production system (100) of one exemplary embodiment of the invention contemplates various alternative embodiments, all of which are encompassed within the scope of the invention.

The following are some advantages of the exemplary embodiments of the invention with respect to the state of the art.

The architecture of the exemplary embodiment of the present invention, with its two independent arrangements, provides for a continuity of production with a sole arrangement yielding a flow of more than fifty percent of production flow.

The architecture of the exemplary embodiment of the present invention allows the entire system to be trial tested on land with all of the available resources and at a lower cost.

In the present architecture the installation of the flow base may be accomplished together with the production line.

The exemplary embodiments allow more resources to be available for cable installation.

The submersible centrifugal pumps can be rotodynamic multiphase pumps. These pumps are marketed under the FRAMO brand. This manufacturer, the market leader in this area, has a project to develop a 45 bar pump. In the future pumps of 100 bar, 110 bar, 150 bar and so forth will be required. The project will require new alterations and specifications. In the case of SCPs, arranged in a series, provide increments on the order of approximately 80 bar for each pump positioned in the hydraulic series, without the need for a new project and new specifications. Therefore, when the system requires 160 bar, two pumps may be installed in series and so on.

As related to in the state of art, the following additional advantages of the exemplary subsea production system (100) are noted:

a. Installation by an anchoring vessel of low daily operational cost;

b. Absence of technological barriers, since the invention system includes the integration of dedicated components and state of art, e.g., centrifugal transfer pumps operating in the horizontal position, underwater engineering and installation technologies;

c. No requirement for specific resources, which implies less shutdown time waiting for pump replacement resources;

d. Reduction in shutdown time for retrieving the pumping system for maintenance;

e. Testing and rapid substitution by providing an available backup system;

f. Possibility of performing pump/motor/electrical systems integration functional tests on land and offshore before the positioning of the underwater system on the seabed;

g. Reuse of cables, electrical connectors, flying leads, etc., in the event of pump replacement;

h. The operation of the subsea system on the seabed, in which the system is subjected to thermal changes effected with extreme low temperatures, translates into a better cooling of the electric motor;

i. Possibility of launching the structure together with the production line;

j. Possibility of relocating the flow base (10) and the pumping module (20); and k. Assembly of motor/pump/seals components may be accomplished at the factory under ideal environmental conditions.

Although exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A subsea petroleum production system for artificial lift, installed downstream of a Wet Christmas Tree (WCT), comprising:

a pumping module comprising at least one submersible centrifugal pump (SCP) and a base structure for protecting the at least one SCP against external forces, said at least one SCP being inclined with respect to the vertical direction at an inclination angle of up to 85 degrees from the vertical direction, wherein the flow in said at least one SCP is ascending, and a flow base coupled to said pumping module, provided with an upstream hydraulic connection that receives a petroleum production flow and a downstream connection to a production line, fitted with installation devices and a panel for effecting electrical connections;

wherein the system is installed on a seabed permitting the petroleum production flow to bypass the pumping module.

2. The subsea system in accordance with claim 1, wherein said pumping module and said flow base are installable and recoverable by cable.

3. The subsea production system in accordance with claim 1, wherein the pumping module comprises more than one SCP arranged in series.

4. The subsea production system in accordance with claim 1, wherein the pumping module comprises more than one SCP arranged in parallel.

5. The subsea production system in accordance with claim 1, wherein the at least one centrifugal pump is connected to the flow base through a hub connector.

6. A method of installing the subsea production system in accordance with claim 1 to a new wellhead, wherein said method comprises:

a) providing a pile to be driven into the seabed to facilitate the orientation of the final location positioning of the subsea production system;

b) transporting the flow base;

c) installing the flow base with a line and pull-in at the production unit;

d) coupling the pumping module to the flow base;

e) connecting production lines upstream and downstream of the subsea production system; and f) allowing oil production by artificial lift utilizing the subsea production system.

7. A method of installing the subsea production system in accordance with claim 1 to an existing wellhead provided with a bundle containing a production line, a service line and a control line, said method comprising:

a) removing the production line, aided by a vessel, while the service and control lines remain linked to the production unit;

b) directing the production line to the vessel;

c) calculating a position where the flow base will be installed;

d) initiating a descent of the flow base to the seabed;

e) installing the pump module on the flow base;

f) connecting the production lines upstream and downstream of the subsea production system; and g) allowing oil production by artificial lift utilizing the subsea production system.

8. A method of using the subsea production system, in accordance with claim 1, boosting multiphase flow up to the approximate limit of 60% of gas fraction present in the multiphase flow.

9. A method of using the subsea production system in accordance with claim 1, providing at least two systems are installed in series.

* * * * *